US005975412A

United States Patent [19]

Guillin

[11] Patent Number: 5,975,412

[45] Date of Patent: Nov. 2, 1999

[54] FOOD PACKAGING CARTON

[75] Inventor: Francois Guillin, Mouthier Hautepierre, France

[73] Assignee: Groupe Guillin S.A., Ornans, France

[21] Appl. No.: 09/077,034

[22] PCT Filed: Nov. 19, 1996

[86] PCT No.: PCT/FR96/01821

§ 371 Date: May 18, 1998

§ 102(e) Date: May 18, 1998

[87] PCT Pub. No.: WO97/18996

PCT Pub. Date: May 29, 1997

[30] Foreign Application Priority Data

Nov. 21, 1995 [FR] France ..... 95 13782

[51] Int. Cl.[6] ..... B65D 5/35

[52] U.S. Cl. ..... 229/122.22; 229/122.21; 229/162; 220/4.21; 220/62; 220/602; 220/611; 220/617; 220/655; 220/DIG. 25

[58] Field of Search ..... 229/162, 122.21, 229/122.22, 122.23; 220/4.21, 62, 602, 611, 615, 617, 618, 662, 665, 674, 675, 676, 682, 690, DIG. 25

[56] References Cited

U.S. PATENT DOCUMENTS

| | | | |
|---|---|---|---|
| 1,140,765 | 5/1915 | Payne | 299/122.21 |
| 2,006,780 | 7/1935 | Trew | 220/DIG. 25 |
| 2,481,302 | 9/1949 | Fogel | 220/DIG. 25 |
| 2,741,390 | 4/1956 | Moore | 220/DIG. 25 |
| 2,790,589 | 4/1957 | Moore | 229/162 |
| 3,184,140 | 5/1965 | Peterson | 229/122.23 |
| 3,487,991 | 1/1970 | Stern | 229/122.22 |
| 3,746,242 | 7/1973 | Troth | 229/162 |
| 4,637,544 | 1/1987 | Quercetti | 229/122.22 |
| 5,265,797 | 11/1993 | Velge et al. . | |

FOREIGN PATENT DOCUMENTS

| | | | |
|---|---|---|---|
| 6813 | 1/1980 | European Pat. Off. | 229/162 |
| 40/5132057 | 5/1993 | Japan | 229/162 |
| 434530 | 9/1935 | United Kingdom . | |
| 464879 | 4/1937 | United Kingdom . | |
| 547523 | 9/1942 | United Kingdom . | |

*Primary Examiner*—Gary E. Elkins
*Attorney, Agent, or Firm*—Young & Thompson

[57] ABSTRACT

A packaging carton comprising a bottom wall (3) surrounded by a side wall and an openable and closable cover (4) hinged to the side wall (2). The side wall consists of an insert (2), and the cover (4) and the bottom wall (3) includes two surfaces, each of which is hinged toa connecting portion (5) to form a three-panel assembly. The surfaces (3, 4) include abutment members (6, 7) engaging the inner and/or outer rim of the respective edge of the insert (2), and separable closure means are built into the three-panel assembly and/or the insert (2), or inserted after the carton has been closed. The carton is useful for packaging food.

26 Claims, 10 Drawing Sheets

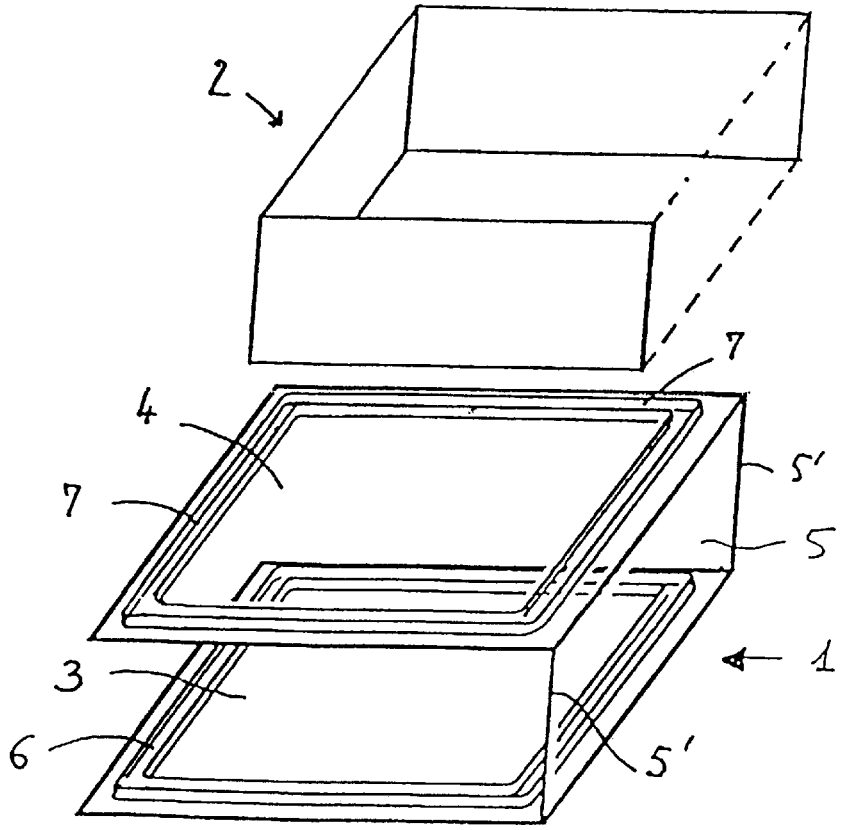
Fig 1
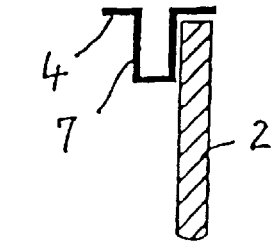
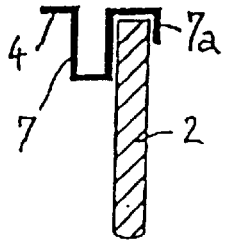
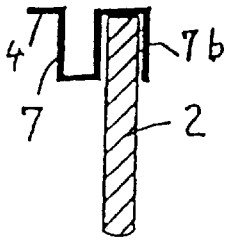
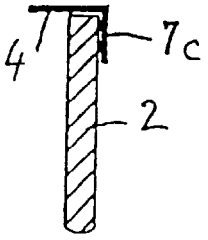
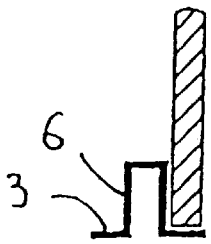
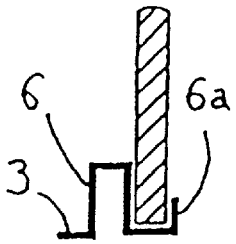
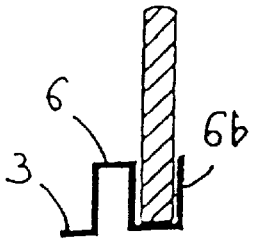
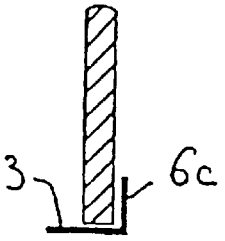
Fig 2 Fig 3 Fig 4 Fig 5

FOOD PACKAGING CARTON

The invention relates to a packaging carton for products, particularly foodstuffs such as pastry.

Packaging cartons conventionally used by suppliers, in particular butchers, bakers and candy makers, are generally of cardboard cut to shape, folded and glued. These conventional boxes permit production of the product which has been chosen by the purchaser from a shelf or a cabinet and then placed in packaging, which can easily be decorated by printing and personalized with the name of the supplier. Such a carton, which enjoys the sense of tradition and quality of the supplier, is not usable in industry and the distribution of foodstuffs because of its cost for production and filling. It suffers moreover from the major drawback of not permitting the foodstuff it contains to be seen.

To overcome this last drawback, there have been developed cardboard cartons on which a cover is applied or a transparent film or in the walls of which are provided openings then closed by transparent or translucent film. These openings constitute a point of weakness of the carton, particularly as to its resistance to compression.

There are also known packaging cartons entirely of transparent or translucent material, which permits total and direct vision of the contained product. In this case, there are usually used cartons constituted of a single piece of thermoformed plastic material. Conventionally, a first portion of this piece has a hollow compartment or base for the reception of the product and the second portion serves as the cover. This second portion being hinged on the first to close it by bending the plastic material between the two parts with if desired a snap closure between the cover and the base. For the presentation of information relative to the enclosed product, these packagings are practically limited to labels applied to the transparent box or printed sheets at least partially obstructing the sight of the contents.

If these transparent cartons have advantages of permitting high visibility of the contents, of being easily stacked in a minimum volume before use and permitting simple and economical filling, they are poorly adapted for expensive contents, such as for example pastries, because of their relatively poor and inelegant appearance.

So as to overcome these drawbacks, the invention proposes a new type of packaging carton comprising two separate elements which, before making up the box itself, have a small thickness permitting storage with reduced size by nesting, easy separation by unnesting and of which at least one of the elements can serve as a support for information.

To this end, the invention has for its object a carton of the type comprising a base surrounded by a peripheral wall and a cover articulated on this peripheral wall and adapted to be closed and opened, said peripheral wall comprising a crown, the cover and the base comprising two surfaces each articulated on a connecting member so as to form a triptych, characterized in that said surfaces comprise abutment members against the internal and/or external periphery of the respective edge of said crown, means to maintain in closed position the carton being integrated with the triptych and/or with the crown or being applied after closure of the carton.

There is known from GB-A-434.530, a carton comprising a base surrounded by a peripheral wall and a cover articulated on this peripheral wall and adapted to be opened and closed, the cover and the base comprising two surfaces each articulated on a connection member so as to form a triptych. In this known carton, a peripheral strip surrounds an edge of the bottom bent and retracted, so as to maintain the assembly thus folded. This peripheral strip has for its only purpose to retain the bent periphery of the bottom in a complicated construction of carbon, requiring moreover an assembly by stapling or the like. Thus, in this known carton, the lateral strip does not coact with abutment members of the cover and of the base, but only with the peripheral wall that it totally covers.

The abutments against which the internal or external periphery of the respective edge of the crown come into contact, are preferably formed by continuous and/or discontinuous projections and/or points directed inwardly of the crown from the surfaces of the triptych.

The triptych thus produced has a small thickness and is stored by stacking in a reduced storage volume and can be easily extracted from the stack thus formed. The crown can be secured on the connection member by any known means and can preferably be bent so as not to impede stacking.

During use of such a carton, the product is loaded on one of the surfaces of the triptych constituting the bottom, then the crown is emplaced on said surface and the other surfaces of the triptych are bent into position, which is to say that the connection member extends transversely to the crown and the second surface of the triptych extends parallel to the first surface on which the product rests, the abutment members of said second surface coming to rest against the periphery of the upper edge of the crown, said crown thus ensuring sufficient resistance to compression.

Preferably, the crown has a tubular shape, its lower end resting against the first surface of the triptych constituting the base of the carton and its upper end receiving the second surface constituting the cover. According to the shape which it is desired to give the carton, said crown can be cylindrical, in particular a cylinder of revolution, truncated conical, truncated pyramidal or of any shape. The edges of the crown can then be in planes which are parallel or not. Said crown can also have at least one edge of any shape such as crenelated or wavy for decorative and/or ventilating purposes.

As a modification of the tubular shape, the crown can be continuous but open, if desired with partial overlapping.

In a particularly simple form, the crown can be discontinuous facing at least one portion of the connection member.

Preferably, the crown is made of cardboard or plastic material and can serve as a support for information and/or any decorative motifs.

Said crown can moreover comprise at least one recess which can then be partially or completely closed by a transparent or translucent film. According to a modification, the closure of the recess of the crown can be carried out by the connecting member resting against said U-shaped member and which comprises an embossment coacting with said recess.

According to one embodiment of the invention, at least one of the surfaces constituting the triptych can comprise at least a prolongation of the end and/or at least a lateral flap. Said end prolongation or lateral flap can then comprise an embossment which coacts with a corresponding recess of the crown.

The coaction of the embossments with the respective opening can be carried out from outside or from inside the corresponding surface of the triptych.

Preferably, the two surfaces and the connection member forming the triptych and, if desired, the end prolongations and/or the lateral flaps, are made from a single piece, preferably of transparent plastic material. The piece is then made by thermoforming and is easily stored in reduced volume by nesting thanks to the fact that the thermoforming implies clearances for the protruding portions.

The closure means of said carton can be added and can be of any known type such as adhesive strips, elastic, ribbons or staples.

There can also be provided integrated closure means of a known type such as lugs coacting with holes, tongues suitable for corresponding slots, etc. In the case of integral closure means, the latter can be carried by the two surfaces and/or on the end flaps and/or on tongues.

Another closure means can consist of points, lines or preglued surfaces on the triptych and/or the crown.

There will now be described in greater detail examples of embodiment of the invention with reference to the accompanying drawings, in which:

FIG. 1 is an exploded perspective view of a carton according to an embodiment of the invention;

FIGS. 2 to 5 show schematically in fragmentary cross section various shapes for coaction of the crown with the abutments of the two surfaces of the triptych;

Figure 6:
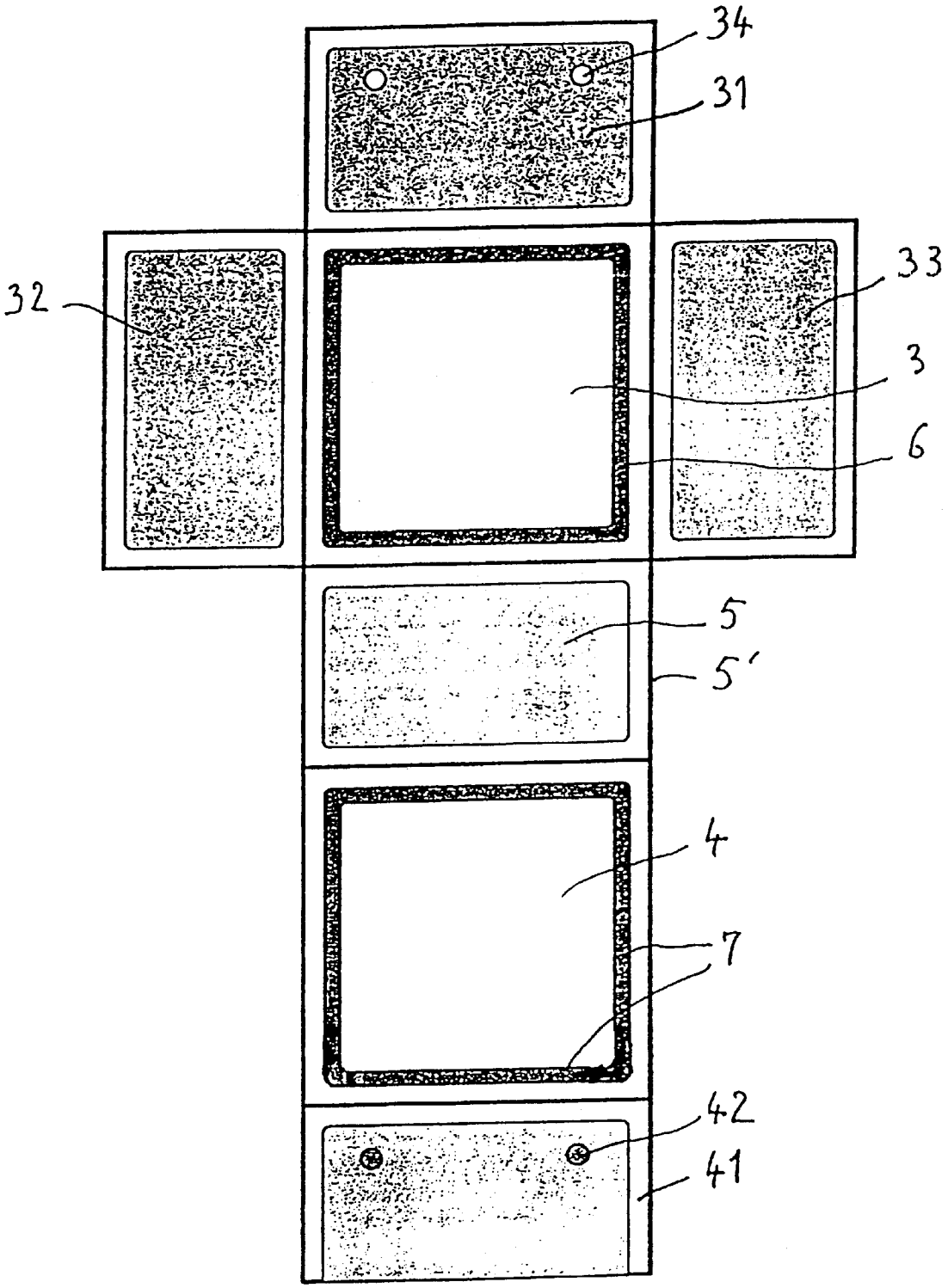
FIG. 6 shows a schematic plan view of a triptych according to a second embodiment of the invention.

According to the embodiment of carton shown in FIG. 1, the latter is constituted by a triptych 1 and a U-shaped member 2. The triptych 1 is constituted of a substantially rectangular piece of plastic material comprised by two surfaces 3 and 4 hinged on a connection member 5. The surface 3 constitutes the bottom of the carton whilst the surface 4 forms the cover.

On the external surface of each of these surfaces 3 and 4 of the triptych are formed ribs or projections 6 and 7 respectively, which, projecting from the opposite surface of said surfaces 3 and 4, constitute abutment members against the periphery of the respective edges of the crown 2.

Figure 8:
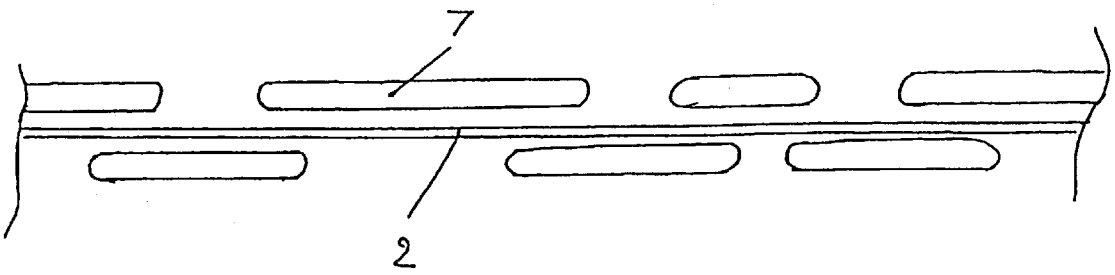
FIG. 8 shows schematically a modification of a discontinuous projection of the triptych.

In the example of FIGS. 1, 6 and 9–15, the ribs 6 and 7 are formed continuously so as to come into abutment against the periphery of the crown 2 in a continuous manner. It is also possible to provide point form or discontinuous abutments (FIG. 8). Any combination of projections which will be described is feasible.

In the embodiment shown in FIG. 1, the crown 2 is discontinuous, its surface facing the connection member 5 being omitted. Such omission can be only partial, with one or two end folds of the crown 2 facing the corresponding edge or edges of the connection member.

The crown 2 can be open, for example at one corner or even comprise a covered region.

Preferably, the crown is tubular, which is to say continuous and closed, as is the case for example of the crown shown in FIGS. 7 and 9–15.

In all cases, at least one of the lateral surfaces of the carton, beyond the surface including the connection member 5, is constituted exclusively by a portion of the crown 2.

The connection member 5 and the edges 5' formed by said member 5, permit increasing the resistance to compression of the carton thus obtained. The ribs 6 and 7 form reinforcing beams for the carton which, because of their abutment against the edges of the crown 2, constitute a self-blocking system of high rigidity and compression both vertically and transversely. it In the case of the embodiments shown schematically in FIGS. 2, 3, 4, and 9–15, the rib 6 or 7 is an abutment against the internal periphery of the crown 2. Moreover, in the case of FIG. 3, a flange 6*a* on the bottom 3 and a flange 7*a* on the cover 4 form external abutments for the crown 2. In the case of FIG. 4, the flanges 6*b* and 7*b* are prolonged substantially to the height of the respective rib 6, 7. In the embodiment of FIG. 5, the abutments are formed by flanges 6*c* and 7*c* of the bottom 3 and of the cover 4 respectively and act on only the external periphery of the crown 2. Any combination of these abutment means can also be adopted.

Figure 7:
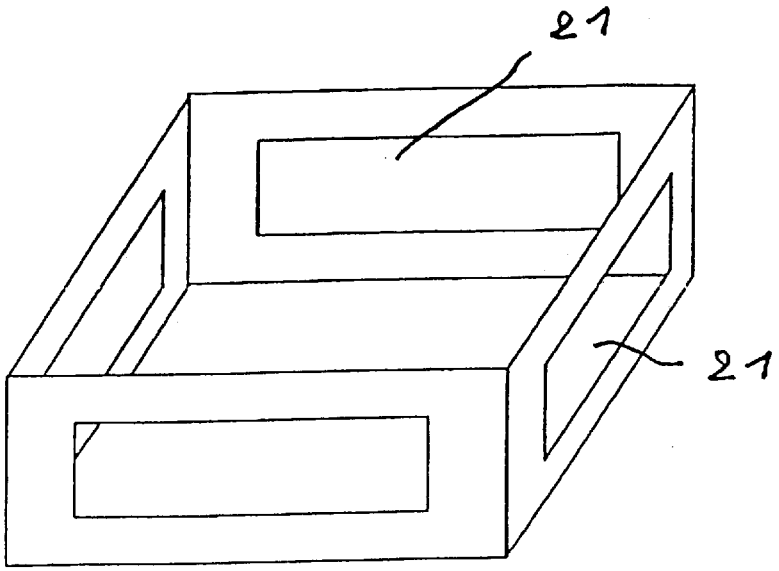
FIG. 7 shows a schematic view in perspective of a crown usable with the triptych of FIG. 6.

FIGS. 6 and 7 show an embodiment of the carton according to the invention in which the crown 2 (FIG. 7) comprises a rectangular recess 21 on each of its lateral walls and the bottom 3 comprises an end flap 31 and two lateral flaps 32 and 33 whilst the cover 4 has an end flap 41. Each of these flaps 31, 32 and 33 comprises an embossment adapted to engage in one of the recesses 21 of the crown 2.

The crown 2 comprising a rectangular recess 21 on each of its walls, is emplaced on the bottom 3, its periphery of the internal edge being in abutment against the rib 6 of the bottom 3. The connecting member 5 provided with an embossment corresponding to a recess 21 in the crown 2, is bent such that said embossment comes into engagement in the corresponding recess 21 of the crown 2 whilst the embossments of the side flaps 32 and 33 and of the end flap 31 engage in corresponding recesses 21 of the crown 2.

The cover 4 is then lowered onto the periphery of the upper edge of the crown 2 and the end flap 41, provided also with an embossment, is lowered onto the end flap 31 of the bottom 3, the embossment of the flap 41 being received in the embossment of the flap 31. The flap 31 comprises snap-in holes 34 in which engage complementary lugs 42 provided on the flap 41 so as to close the box thus constituted.

As a modification or in addition, the closure means are carried by tongues prolonging the bottom and/or the cover, or else formed directly on the bottom and the cover.

It can also be provided, as an addition to or as a modification of the preceding closure means, that the triptych and/or the crown comprise points and/or surfaces and/or preglued lines which permit or facilitate setting up and closing of the carton.

The connection member 5 can have any shape and dimensions. It can for example be formed by a narrow rectangular, trapezoidal strip with straight or curved lateral edges.

The crown 2 can be of any material such as cardboard or plastic material.

The crown 2 can have any shape, for example cylindrical, of square cross section in the illustrated examples, or else as a cylinder of revolution, truncated conical, truncated pyramidal, etc.

The edges of the crown 2 adapted to coact with the projections 6, 7, 6*a*, 7*a*, 6*b*, 7*b* and/or 6*c*, 7*c* can be in planes which are parallel or not. At least one of the edges can be out of a plane and have any shape, for example crenelated or wavy.

The bottom 3 and/or the cover 4 end generally in the vicinity of the exterior of the crown 2. They can however be prolonged beyond the crown 2, in particular to facilitate gripping the cover 4. It can also be envisaged that the crown 2 will be completely inscribed within the interior of a triptych of different shape, for example with a crown which is a cylinder of revolution and a parallelepipedal triptych.

Figure 9:
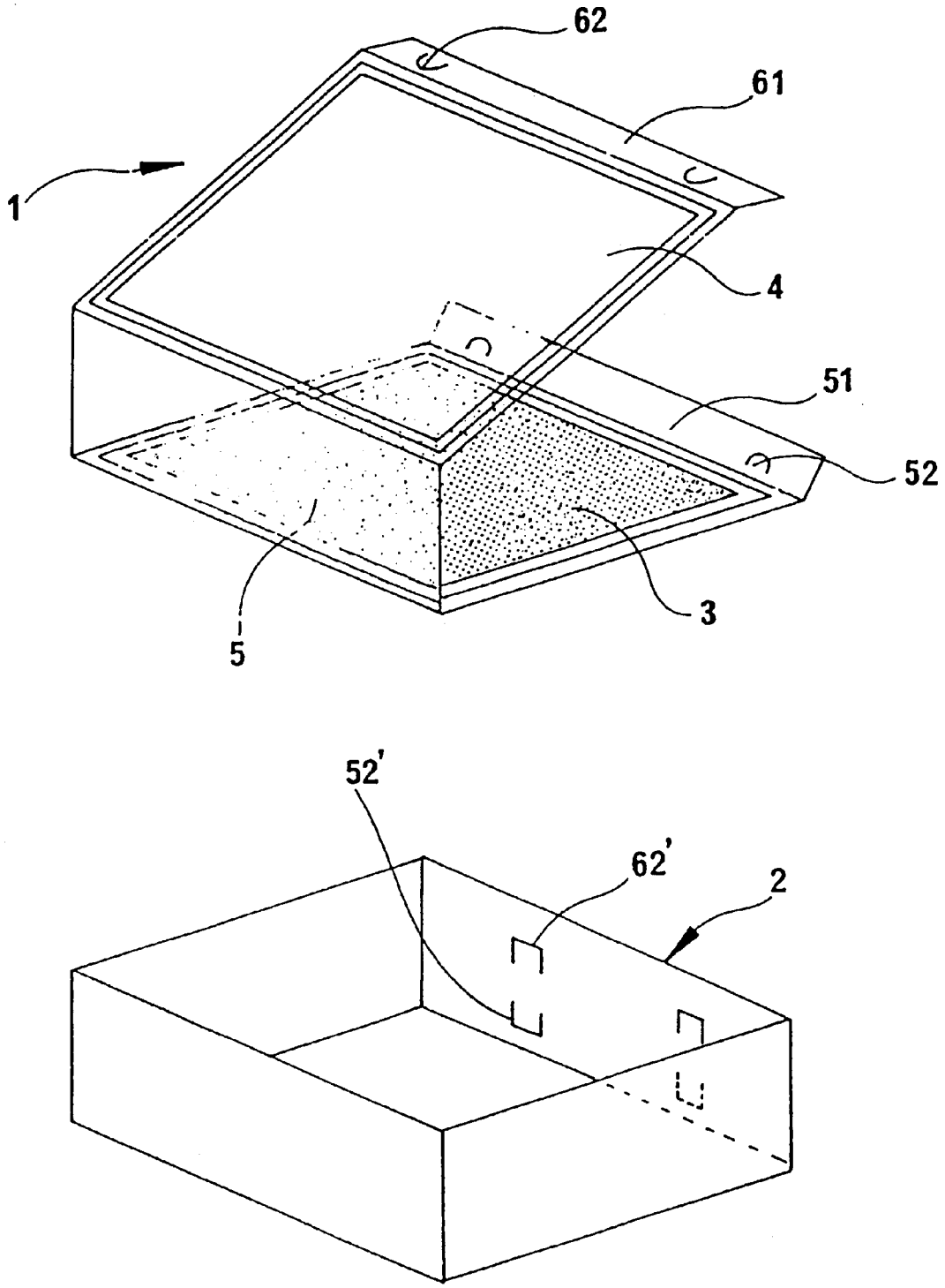
FIGS. 9 to 15 show schematically, in exploded perspective, various embodiments of a carton according to the invention.

In the embodiment of FIG. 9, which constitutes a modification of FIGS. 6 and 7, the flaps 51 and 61 prolonging respectively the surfaces 3 and 4 are not covered after closure and comprise gripping means, such as tongues 52 and 62 respectively, coacting respectively with complementary members such as slots 52' and 62' formed in the crown 2.

Figure 10:
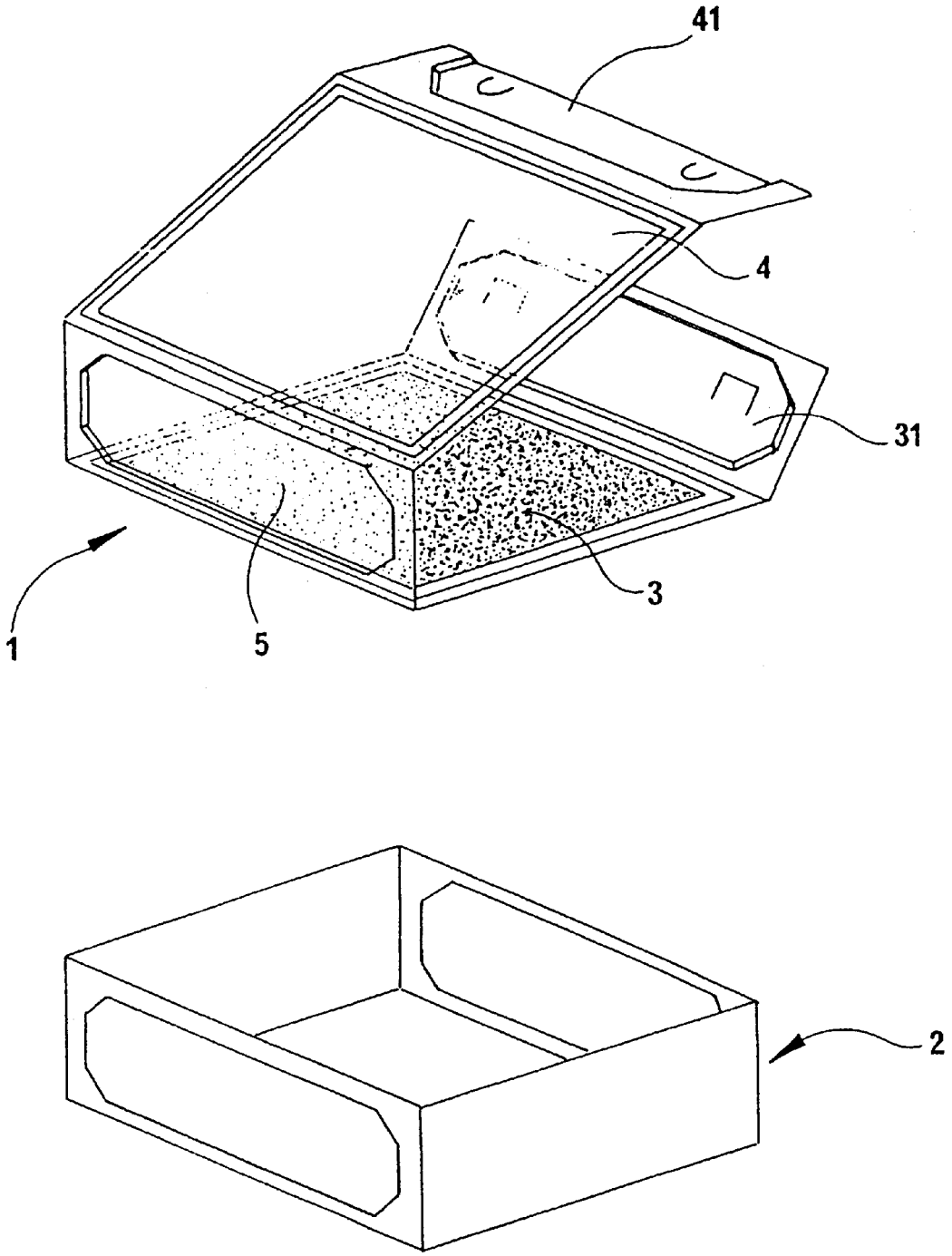

In the examples shown in FIG. 10, the carton is analogous to that of FIGS. 6 and 7, except that the side flaps 32 and 33 have been omitted and the interlocking means of the end flaps 31 and 41 are of the tongue and slot type.

Figure 11:
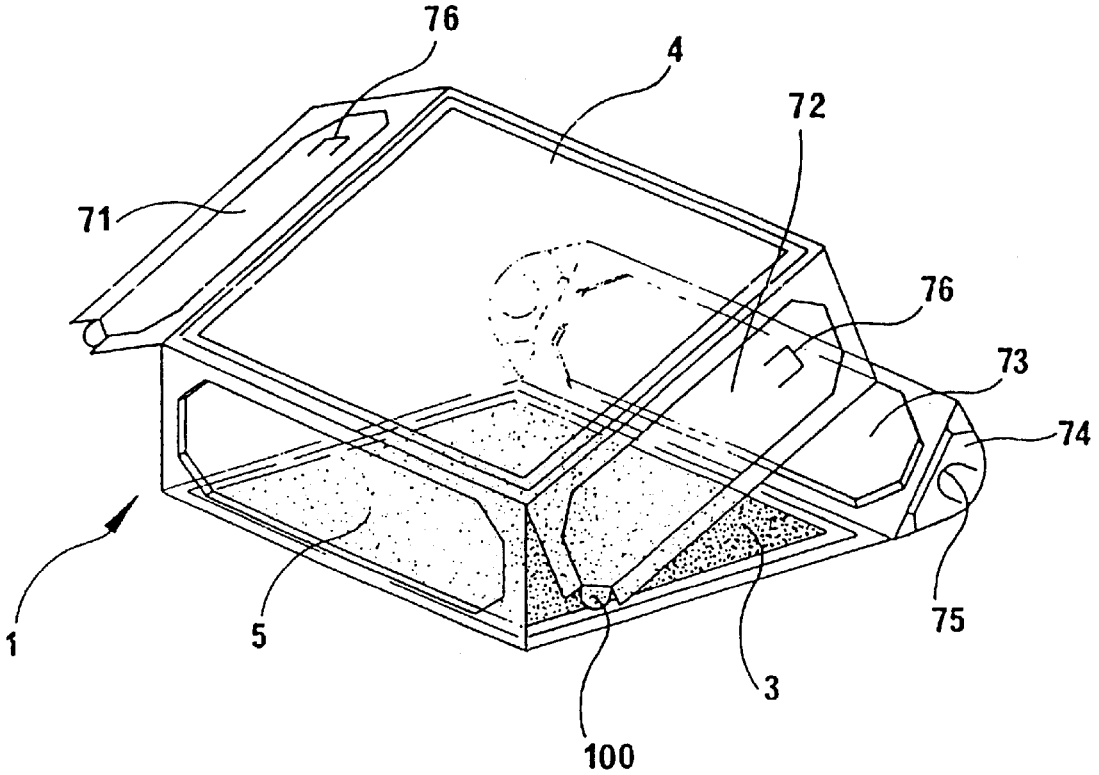
Figure 11:
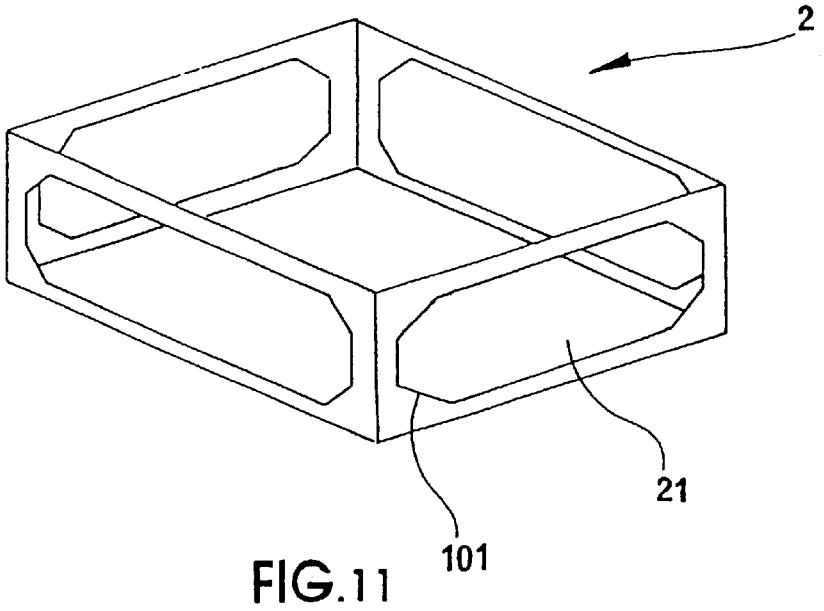

There is shown in FIG. 11 an embodiment of the invention in which all the external surface of the carton is formed, as in the case of FIGS. 6 and 7, by the triptych 3, 4, 5 and the flaps. The surface 4 of the triptych, instead of the bottom surface 3, comprises two lateral flaps 71 and 72 whilst the surface of the bottom 3 is prolonged by an end flap 73 provided with lateral tongues 74. The tongues 74 comprise a locking means, such as a tongue 75 coacting with complementary means, such as a slot 76 of the adjacent lateral flap 71 and 72. It will be noted moreover, in this example, that the lateral flaps 71 and 72 comprise, in one corner, an oblique tongue 100 which, after setting up the assembly, will be disposed below the corresponding corner 101 of a recess 21 of the crown 2, thereby reinforcing the locking obtained by the embossments.

Figure 12:
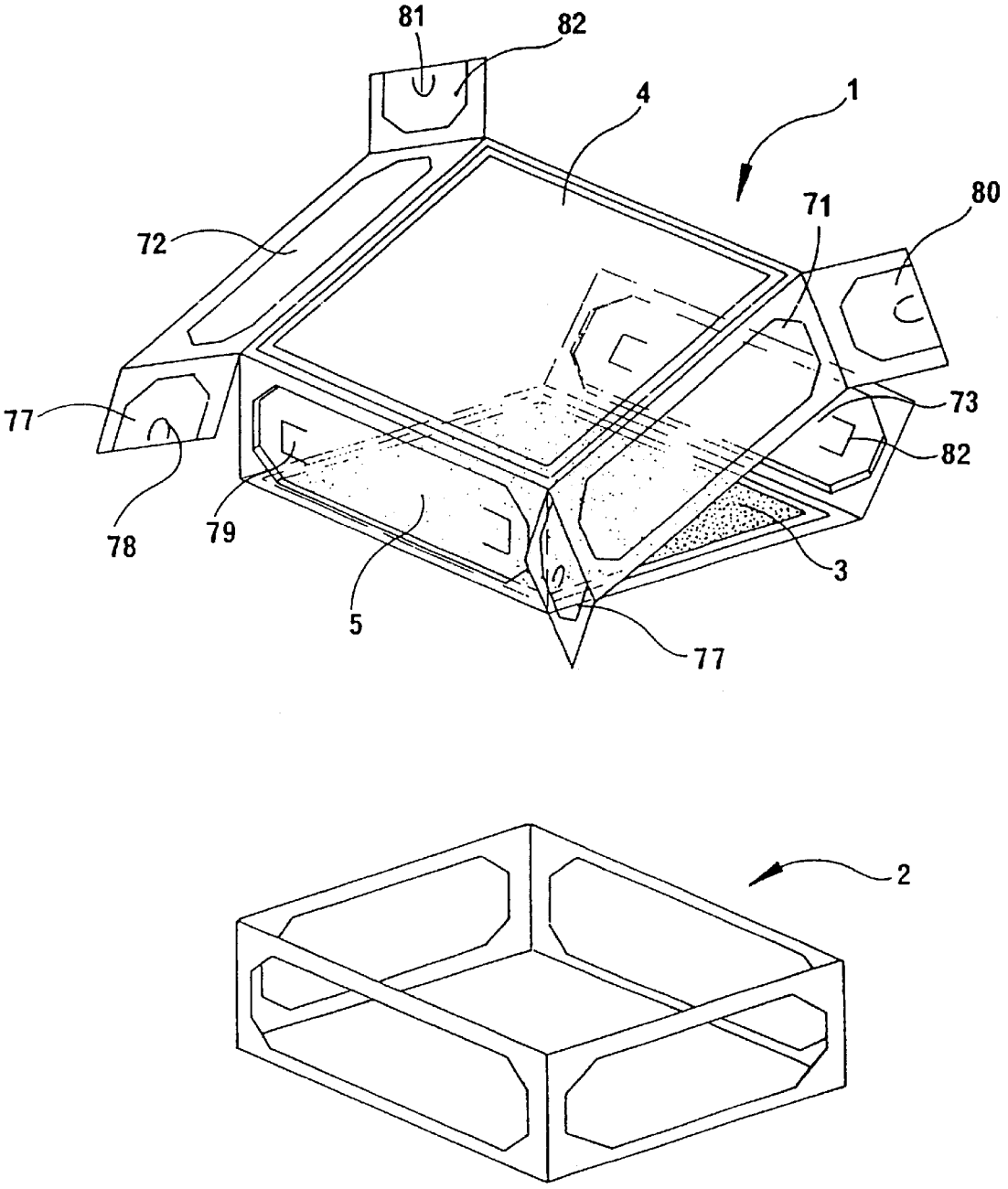

In the example of FIG. 12, analogous to that of FIG. 11, the side flaps 71 and 72 of the surface 4 are provided with end tongues 77 provided with tongues 78 for locking in the slots 79 of the connection member 5, other end tongues 80 of the lateral flaps 71 and 72 being provided with tongues 81 coacting with the slots 82 of the end flap 73 of the surface 3 of the bottom.

Figure 13:
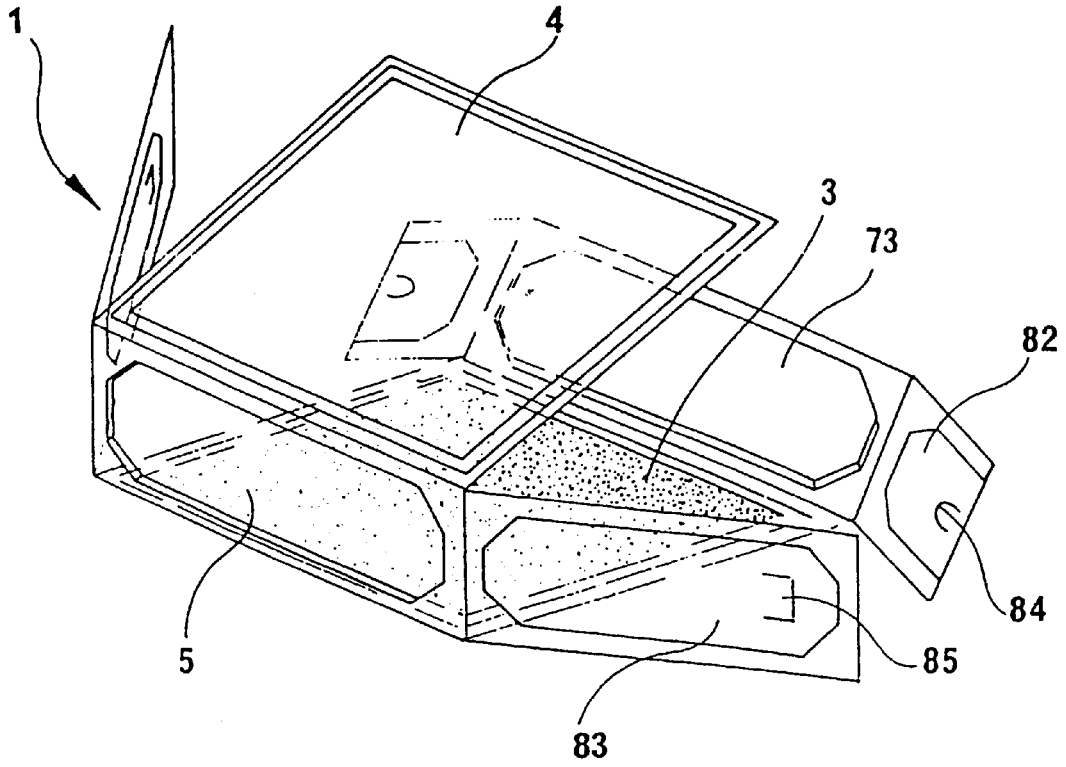
Figure 13:
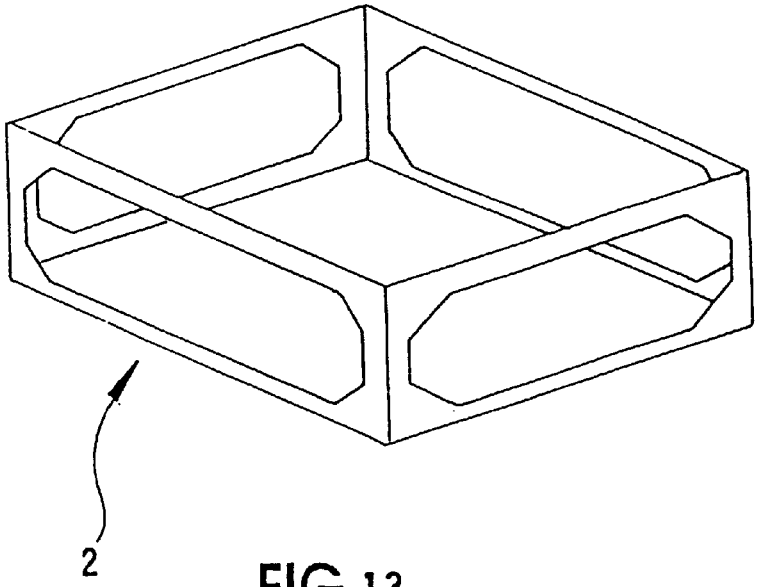

In FIG. 13, the end tongues 82 of the end flap 73 of the surface 3 coact with lateral prolongations 83 of the connection member 5, these lateral prolongations 83 occupying a lateral surface of the carton after assembly. Locking is effected by tongues 84 of the tongues 82 coacting with slots 85 of the prolongations 83.

Figure 14:
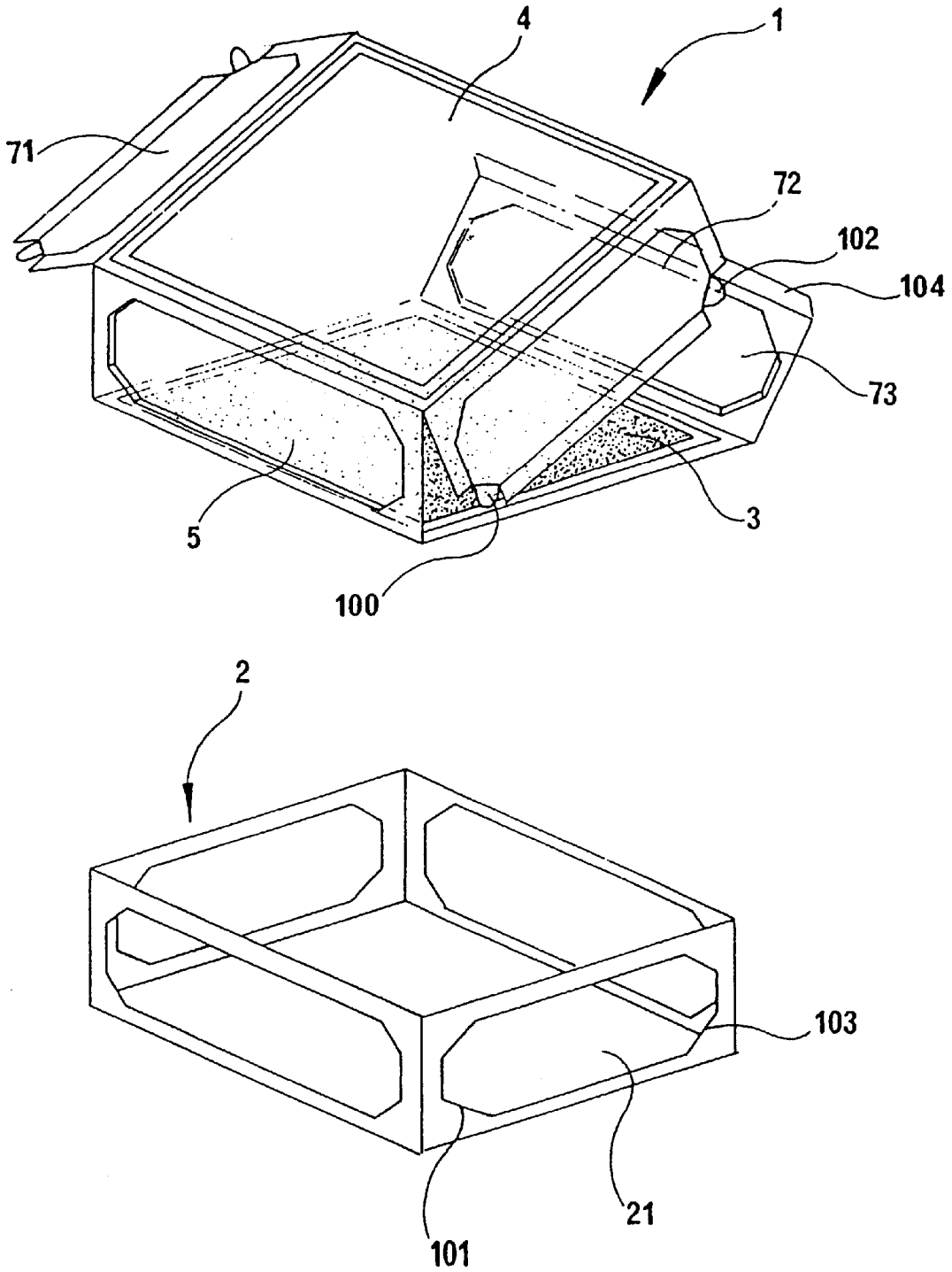

FIG. 14 shows a modification of FIG. 11 in which the tongues 74, the tongues 75 and the slots 76 have been omitted, locking being ensured by oblique tongues 102, analogous to the oblique tongues 100 of FIG. 11, also present in this case. The oblique tongues 102 coact with a corner 103 of the window recess 21 in the crown 2. It will be noted moreover that the end flap 73 is prolonged by tab 104 sliding below the front edge of the surface 4 and permitting closing the flap 73 before locking.

Figure 15:
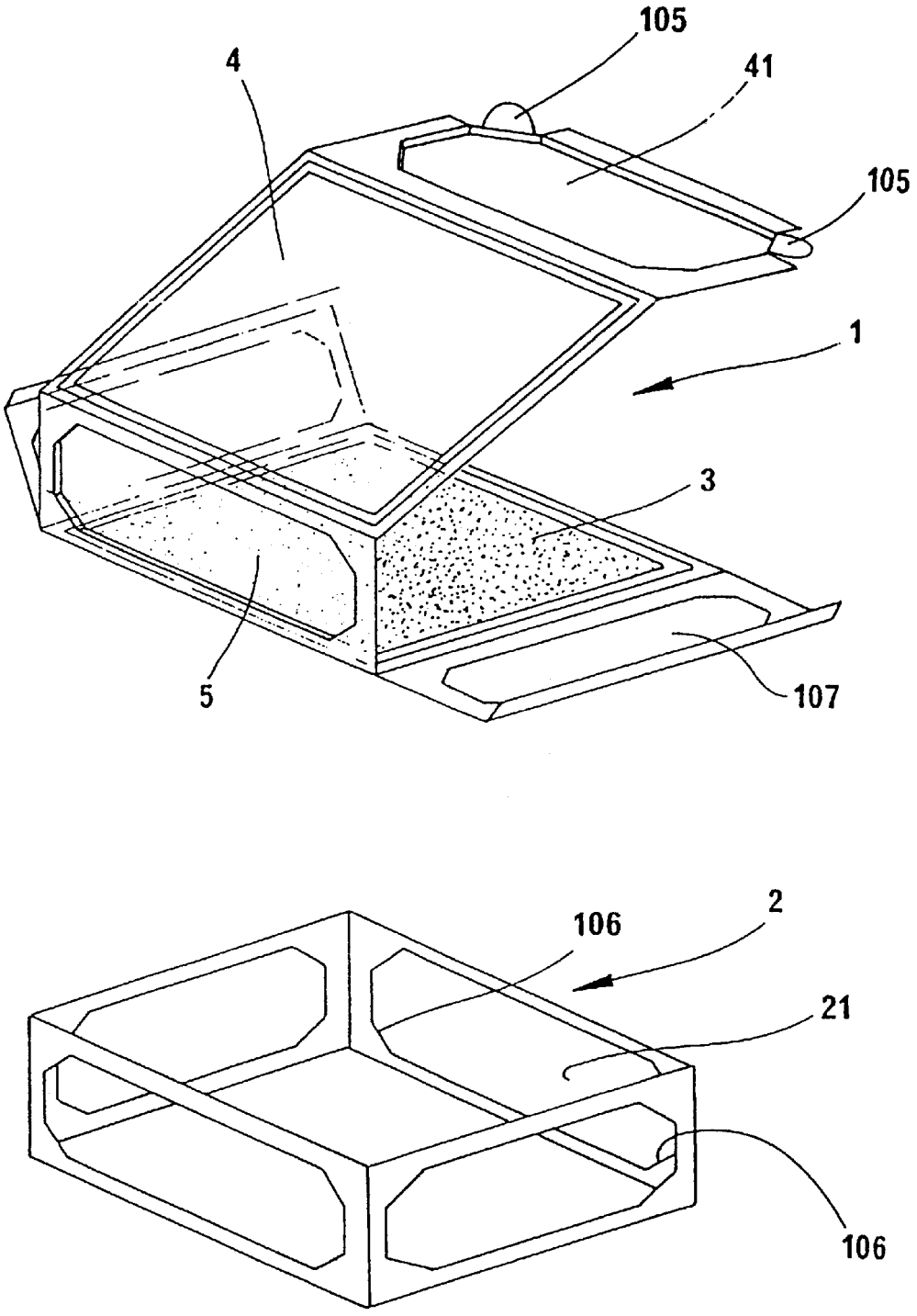

In the example of FIG. 15, analogous to that of FIGS. 6 and 7, the end flap 41 of the surface 4, which has a height corresponding to that of the crown 2, is provided at its two free corners with oblique tongues 105, analogous to the tongues 100 of FIG. 11 and 102 of FIG. 14, which coact respectively with the lower corners 106 of the corresponding recess 21 in the crown 2. These lateral prolongations 32 and 33 of the bottom surface 3, which can be omitted, each comprise a tab 107 analogous to the tab 104 of FIG. 14.

These embodiments of FIGS. 14 and 15 offer the advantage that, when the carton is assembled, the securement means are entirely invisible.

I claim:

1. Carton of the type comprising a bottom (3) surrounded by a peripheral wall and a cover (4) articulated on said peripheral wall (2) and adapted to be closed and opened, said peripheral wall comprising a crown (2), the cover (4) and the bottom (3) comprising two surfaces each articulated to a connection member (5) so as to form a triptych, characterized in that said surfaces (3, 4) comprise abutment members (6, 7; 6*a, 7a; 6b, 7b; 6c, 7c*) against the internal and/or external peripheral of the respective edge of said crown (2), separable closure members being integrated with said triptych and/or with said crown (2) or being connected after closing the carton.

2. Carton according to claim 1, characterized in that the abutments are formed by continuous projections (6), discontinuous projections (7) and/or by points, directed inwardly of the crown (2).

3. Carton according to claim 1, characterized in that the crown (2) comprises at least one recess (21).

4. Carton according to claim 3, characterized in that said recess (21) is partially or completely closed by a transparent or translucent film.

5. Carton according to claim 3, characterized in that the connection member (5) comprises an embossment coacting with a corresponding recess (21) of the crown (2).

6. Carton according to claim 1, characterized in that at least one of the surfaces (3, 4) comprises at least one end prolongation (31, 41) and/or at least one lateral flap (32, 33).

7. Carton according to claim 6, characterized in that said prolongation (31, 41) and/or said lateral flap (32, 33) are provided with an embossment coacting with a corresponding recess (21) of the crown (2).

8. Carton according to claim 1, characterized in that the crown (2) is of cardboard.

9. Carton according to claim 1, characterized in that the crown (2) is of plastic material.

10. Carton according to claim 1, characterized in that the crown (2) is of tubular, cylindrical, in particular a cylinder of revolution, truncated conical, truncated pyramidal or any other shape.

11. Carton according to claim 1, characterized in that the crown (2) is interrupted at least partially facing the connection member (5) of the triptych (3, 4, 5).

12. Carton according to claim 1, characterized in that the crown (2) is open.

13. Carton according to claim 1, characterized in that the edges of the crown (2) are in parallel planes.

14. Carton according to claim 1, characterized in that the edges of the crown (2) are not in parallel planes.

15. Carton according to claim 1, characterized in that at least one edge of the crown (2) has any shape such as crenelated, wavy.

16. Carton according to claim 1, characterized in that the two surfaces (3, 4) and the connection member (5) and, if desired, the prolongations and the flaps (41, 31, 32, 33), are of one piece.

17. Carton according to claim 16, characterized in that said piece is of transparent plastic material.

18. Carton according to claim 17, characterized in that said piece is produced by thermoforming.

19. Carton according to claim 1, characterized in that the product is loaded on the second surface (3), then the crown (2) is emplaced and the other surfaces (5, 4) of the triptych and if desired the flaps (41, 31, 32, 33) are folded into position.

20. Carton according to claim 1, characterized in that the crown (2) is fixed on the internal surface of the connection member (5) by any known securement means and bent so as not to hinder stacking by nesting.

21. Carton according to claim 1, characterized in that the added closure means are of any known type such as adhesive strip(s), elastic(s), ribbon (s), staple(s).

22. Carton according to one of claim 1, characterized in that the integrated closure means are known complementary means such as lugs (42) and holes (34), tongues (52, 62, 75, 78, 81, 84) and slots (52', 62', 76, 79, 82, 85).

23. Carton according to claim 22, characterized in that said integrated closure means are carried by the surfaces (3, 4) of the triptych (3, 4, 5) and/or by flaps prolonging them.

24. Carton according to claim 22, characterized in that said integrated closure means are carried by end flaps (41, 31).

25. Carton according to claim 1, characterized in that the triptych (3, 4, 5) and/or the crown (2) comprise points and/or surfaces and/or preglued lines.

26. Carton according to claim 1, characterized in that the integrated closure means comprise oblique tongues (100, 102, 105) at a free corner of a flap (71, 72, 41) prolonging a surface (3, 4) of the triptych, said tongues being arranged to come, in the course of closing, to slide below a corner (101, 103, 106) of a corresponding recess (21) of the crown (2).

* * * * *